United States Patent [19]

Griffis

[11] Patent Number: 4,580,333

[45] Date of Patent: Apr. 8, 1986

[54] PROCESS FOR PREVENTING FILM STRIPPING AND GROOVING OF A COMMUTATOR

[75] Inventor: Daniel L. Griffis, Erie, Pa.

[73] Assignee: General Electric Company, Salem, Va.

[21] Appl. No.: 631,631

[22] Filed: Jul. 17, 1984

Related U.S. Application Data

[62] Division of Ser. No. 378,579, May 17, 1982, abandoned.

[51] Int. Cl.[4] ..... H01R 43/14

[52] U.S. Cl. ..... 29/597; 29/401.1; 29/402.04; 29/826; 310/42; 310/239; 310/248

[58] Field of Search ..... 29/527, 826, 401.1, 29/402.04, 402.08; 310/42, 239–249

[56] References Cited

U.S. PATENT DOCUMENTS

| | | | |
|---|---|---|---|
| 1,713,089 | 5/1929 | Phillips | 310/233 |
| 1,719,407 | 7/1929 | Trudeau | 310/228 |
| 1,934,521 | 11/1933 | Bollinger et al. | 310/233 |
| 2,186,240 | 1/1940 | Fockler et al. | 310/239 |
| 2,822,486 | 2/1958 | Newell, Jr. | 310/246 |
| 3,387,155 | 6/1968 | Krulls | 310/240 |
| 3,471,732 | 10/1969 | Drabik | 310/239 |
| 4,246,507 | 1/1981 | Weldon et al. | 310/242 |
| 4,338,538 | 7/1982 | Major | 310/242 |
| 4,344,008 | 8/1982 | Major et al. | 310/242 |
| 4,347,455 | 8/1982 | Major et al. | 310/239 |
| 4,366,404 | 12/1982 | Ziegler | 310/239 |

FOREIGN PATENT DOCUMENTS

| | | | |
|---|---|---|---|
| 55-103059 | 8/1980 | Japan | 310/239 |

*Primary Examiner*—Carl E. Hall

*Attorney, Agent, or Firm*—Arnold E. Renner

[57] ABSTRACT

A process and apparatus for preventing film stripping and grooving of a dynamoelectric machine commutator. The process is usable in either repairing or initially manufacturing a high-powered, high-speed dynamoelectric machine. In the process, extra-wide brushes and associated brush holders are mounted in place of conventional standard size brushes and brush holders in order to restrict variations in current unbalance between a plurality of electrically paralleled brushes to a range of 10 to 15% of rated full load brush current density in the brushes at rated load. A machine constructed according to the invention is made with a plurality of extra-wide brushes and brush holders, with no more than four brushes electrically connected in parallel on respective brush holder studs positioned in operating relationship around the commutator thereby to so restrict the permitted range of current density unbalance between brushes.

7 Claims, 7 Drawing Figures

PROCESS FOR PREVENTING FILM STRIPPING AND GROOVING OF A COMMUTATOR

This application is a division of application Ser. No. 378,579, filed May 17, 1982, now abandoned.

BACKGROUND OF THE INVENTION

The invention is related to a process for preventing film stripping and grooving of a dynamoelectric machine commutator and, more particularly, is related to a method for making high-powered, high-speed dynamoelectric machinery having unique brush holders and brush constructions that are effective to prevent such film stripping and commutator grooving. Also an improvement in high-powered, high-speed dynamoelectric machine structures is disclosed for achieving those objectives and for limiting the current unbalance occurring between parallel brushes mounted in sets, respectively, on common brush studs to a range of 10 to 15% of the average brush current under any load during normal operating conditions of such machines.

Ever since the initial development of direct current dynamoelectric machines, efficient commutation of armature current has been a major design challenge. In general, it is desirable for current reversal in armature coils undergoing commutation to be made to approach a straight line mode, as represented on a time scale, so that the necessary 180° reversal is virtually a constant rate of change. Even in machines using carefully placed commutating poles having properly arranged useful flux, however, it is recognized that such ideal commutation is never attained; accordingly, there always exists some circulating current across the thickness of operating commutator brushes. Such circulating currents add to the normal armature load current on one side of a brush and subtract from it on the other side. Therefore, in addition to using commutating poles to improve commutation, designers heretofore have recognized the desirability of carefully restricting the thickness of brushes so that part of the short-circuited zone of a coil under commutation is outside of the zone of a commutating-pole field. Undesirable circulating currents in commutator brushes have also been restricted by designing brushes that are made up of a plurality of wafer-like sections mounted in juxtaposition as a single brush in a brush holder. The resistance between such sections, due to the small air gap at the abutting surfaces of the individual sections, is effective to significantly reduce circulating currents in each brush.

Numerous other causes of commutation difficulties have been identified and related machine design improvements have been developed to bring modern dynamoelectric machine commutation principles to their present relatively effective level. For example, brush contact resistance is dependent on variables such as the brush material composition and variations in current density. Brush contact resistance will decrease as the temperature of the contact increases, consequently, excessive variations in load current can cause undesirable sparking as brush temperatures increase and contact resistance decreases to undesirable levels. The more nearly uniform the current density in the brush contact can be made, the better its commutation will be.

Of course, variations in mechanical forces applied to commutator brushes, such as variations in brush-biasing spring pressure on the brushes, or mechanical vibration of the brushes then causes them to bounce or chatter on a commutator, have been recognized as other causes of poor current commutation. To overcome such problems a wide variety of constant pressure spring arrangements have been developed for suitably biasing brushes against commutators. And brush holders are now conventionally designed with carefully machined brush-engaging surfaces that prevent irregular restriction of movement of the brushes during their normal sliding passage through the holders as the brushes are worn in normal operation of a dynamoelectric machine.

Because dynamoelectric machines are often operated in environments that expose their commutators and brushes to particulate contaminants such as mineral dust or salt spray, as well as to environments that may contain corrosive gases, it has been recognized that commutation efficiency can be improved by maintaining a thin protective film of carbon on a commutator to help prevent its associated brushes from rapidly wearing grooves in the commutator. Special film-forming ingredients are sometimes added to the composition of brushes where it is known that their application will be in particularly corrosive environments such as exposure of the commutator to air-borne chemical dust or compositions or gases like hydrogen sulfide.

It has also been recognized that in cases where machines are often run for long periods at very low loads, their commutators sometimes have a hard glaze built upon them which eventually causes the brushes to chatter, thus resulting in chipping and breaking of the brushes and possibly damaging other components of the brush holder assembly. It has been found that one desirable solution to such glaze buildup is to raise one or more of the brushes in a set of electrically paralleled brushes during such low load conditions, so that the current density in the other brushes is increased sufficiently to avoid such glaze buildup.

Another recognized cause of commutator film stripping and resultant commutator grooving has been observed occasionally on large high-powered dynamoelectric machines such as high speed generators used in earth excavators. In such high-powered, high-speed machines, in order to prevent undesirably high levels of brush sparking at levels of overload up to about 45%, which are often encountered in common duty cycles, it is necessary to employ a plurality of electrically paralleled brushes mounted in sets, respectively, on common brush studs that are positioned around the generator commutator with a conventional yoke. Because such large machines are frequently designed for special applications, significant amounts of engineering effort often are devoted to the selection of suitable brush designs, brush holder structures, and the mechanisms and other features of the machines that determine their commutation efficiency. Thus, some of the longest brush lives reported have been achieved on large dynamoelectric machines, even though such special applications frequently result in the machines being exposed to contaminants, vibration, wide thermal and load cycles, etc.

In addition to carefully designing such critical structural features, engineers installing large dynamoelectric machines are aware of the need to accurately seat new brushes on a commutator so that running friction between the brushes and commutator is minimized thereby to reduce the temperature variation associated with such friction.

As mentioned earlier, the buildup of an effective lubricating film on the commutator during the initial seating-in of brushes on a new commutator is also recognized as an important precaution in achieving desired long brushwear life. Once such a desirable lubricating film has been established on a commutator, and a suitable number of electrically paralleled brushes have been appropriately mounted to satisfy the specific high load current of a given dynamoelectric machine, long periods of brush wear can normally be expected. However, it has been observed that random commutator film stripping and resultant commutator grooving still occur at undesirably frequent intervals on some high-powered dynamoelectric machines, such as high-speed generators used to power certain mining equipment or seagoing vessels. Such failures are believed to be due to so-called electrical wear of the brushes, rather than being due to the various causes of mechanical wear discussed above. Apparently such random failures are caused by certain brushes being forced to carry two or three times their normal rated load current and that condition results in a catastrophic wear rate of the brushes which is known as brush dusting.

When such dusting occurs, it is believed that the necessary film of water or vapor that normally forms at the mechanical load bearing surface between a brush and a commutator is destroyed by some mechanism. It is known that if a clean carbon or graphite brush slides against a clean copper commutator, i.e. in the absence of a suitable lubricating film and in the absence of a film of water or vapor at the load bearing surface, the commutator will be quickly grooved, and rapid wear or dusting of the brush will occur. Thus, if a commutator that has been operating in a stable condition, with a suitable lubricating film on its commutator, is then subjected to an environment, such as very low temperatures and resultant low dew point, which results in the drying out of the load bearing vapor film, the film will no longer suitably cover the sliding surfaces and rapid stripping of the lubricating carbon film and resultant commutator grooving will occur.

In dynamoelectric machine applications where an apparently stable commutator film has been established and no apparent change has occurred in the operating environment to cause a drying of the contact surface vapor film, it is not fully known why many random cases of commutator film stripping and commutator grooving occur. In the past, efforts to reduce the frequency of occurrence of such catastrophic dusting of brushes and resultant film stripping have been directed at sufficiently reducing the exchange of free electrons between the carbon brush dust and the copper dust of the commutator to avoid seizure between the sliding surfaces. Various chemicals such as suitable halides and phosphates have been used with some success in reducing that exchange of free electrons. However, on high-powered machines that operate at high temperatures such materials are often not reliable, because they may be vaporized or evaporate.

Some of the more suitable materials utilized as such dry lubricants are molybdenum sulphide, barium fluoride and lithium carbonate. Normally such materials are used as plugs in the brush surfaces to diminish the exchange of carbon and copper electrons in the absence of a sufficiently large water vapor film at the bearing surface. Although a degree of success has been achieved by the use of such compositions in certain brush applications, the random occurrence of catastrophic brush dusting and commutator film stripping and grooving remains a complex and largely unexplained phenomenon. Thus, of course, it would be desirable to provide a process for preventing such film stripping and commutator grooving when it might otherwise occur at random and for no apparent reason on machines that have been operated under apparently stable conditions. Likewise, if novel apparatus could be developed for avoiding any initial occurrence of such random commutator film stripping and commutator grooving, the resultant savings in machine maintenance and related operating expenses would be apparent.

The use of a plurality of electrically paralleled brushes mounted on common brush holder yokes in high current dynamoelectric machines in various combinations of brushes is generally well known. For example, U.S. Pat. No. 2,822,486, which is assigned to the assignee of the present invention, discloses such a common brush holder yoke arrangement in which three standard size brushes are supported in operating position on a commutator. It is also generally known to employ such parallel connected plural brush arrangements with commutators that have their conducting surfaces separated into discrete elevated sections upon which the individual brushes slide, as shown, for example, in U.S. Pat. No. 1,713,089 which issued on Jan. 3, 1927. The prior art further shows it is known to use two or more biasing springs to drive each brush of an electrically-paralleled set of brushes against a commutator during their normal usage, as shown, for example, in U.S. Pat. No. 3,471,732 which issued on Oct. 7, 1969. In other prior art brush holder arrangements the use of four or more electrically-paralleled brushes mounted on a common brush stud to achieve a desired average current distribution in the respective brushes is well known, as shown in U.S. Pat. No. 2,186,240 which issued Jan. 9, 1940. A further example of a high-powered dynamoelectric machine utilizing sets of four brushes each mounted on a common holder and electrically connected in parallel is shown in U.S. Pat. No. 1,934,521, which issued Nov. 7, 1933. Another typical high powered dynamoelectric machine brush holder arrangement is shown in U.S. Pat. No. 1,719,407 which issued July 2, 1929 and illustrates a commutator having three face sections in combination with a plurality of standard size brush holders which are operable to support two standard size brushes in sliding cooperation with the face of each of the commutator sections. Means are provided to remove dust from the commutator face in order to help cool and clean the machine during its operation.

While my invention, as disclosed herein, is similar in some of its features to various structural aspects of the foregoing prior art references, I do not believe that these references, or any other known prior art, disclose either the novel process, method or apparatus of my invention. Nor do I see that any of these prior art references or any other prior art known to me suggest the unique solutions that I have developed for preventing commutator film stripping and commutator grooving of high-powered, high-speed dynamoelectric machine commutators.

Accordingly, it is an object of the present invention to provide a process for preventing commutator film stripping and commutator grooving of a high-powered, high-speed, dynamoelectric machine that is initially arranged to utilize a plurality of sets of standard-size brushes with the brushes in each set being electrically paralleled and mounted on common studs around its commutator.

Another object of the invention is to provide a method of making a high-powered, high-speed dynamoelectric machine with a plurality of extra-wide brush holders and extra wide brushes that are arranged to cooperate with a commutator to prevent film stripping and grooving of the commutator during both rated and reasonably overloaded operating conditions of the machine.

A further object of the invention is to provide an improvement in high-powered, high-speed dynamoelectric machines by using extra-wide brushes and associated extra-wide brush holders to restrict current density unbalance between brushes to a range of 10 to 15% of the average brush current at rated load and thereby prevent film stripping and grooving of the commutator of the machine.

Additional objects and advantages of the invention will become apparent from the description of it presented herein considered in conjunction with the accompanying drawing.

SUMMARY OF THE INVENTION

In one preferred arrangement of the invention a process for preventing film stripping and grooving of a commutator of a high-powered, high-speed dynamoelectric machine that is constructed with a plurality of standard size brush holders and associated brushes comprises the steps of first replacing selected pairs of the standard size brush holders with extra-wide brush holders each of which hold, respectively, an extra-wide brush that is of a predetermined width relative to the width of one of the replaced original brushes. Next, the extra-wide brushes are each arranged in operating position relative to the commutator of the machine and are electrically connected in parallel sets of brushes, with each set being mounted on a common brush stud to restrict current unbalance between the brushes of a set to a range no greater than about 15% of rated brush load current density at rated load current.

In a related aspect of the invention a high-powered, high-speed dynamoelectric machine structure is improved by mounting a plurality of extra-wide brush holders in operating postions around the machine commutator and then positioning brushes, each having a critical extra-wide dimension, in each of the brush holders, whereby current density unbalance between the respective brushes in sets of electrically paralleled brushes mounted on common brush studs is restricted to a range of 10 to 15% of rated brush load current density at rated load current, to substantially reduce the risk of an occurrence of film stripping and grooving of the commutator of the machine.

BRIEF DESCRIPTION OF THE PREFERRED EMBODIMENTS

Figure 1:
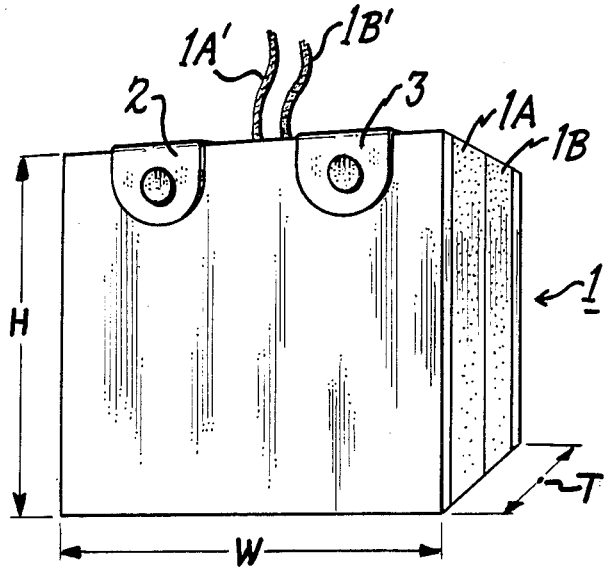
FIG. 1 is an elevation of two sides of an extra-wide brush suitable for use with the extra-wide brush holder of the invention, shown in FIGS. 4 and 5. This figure of the drawing is also used to explain the standard terminology used herein for describing the width, thickness and height dimensions of this and other brushes discussed in the disclosure of the present invention

Because critical changes must be made in relative brush widths in practicing the process and method of the invention, it is desirable at the outset to have a clear understanding of the intended distinction between the terms; width, thickness and height as applied to brush dimensions herein. The same usage of these respective terms as employed herein is recognized by American National Standards Institute (ANSI), thus, as shown in FIG. 1, when reference is made to brush thickness, the dimension measured in the sliding direction of the brush relative to a commutator is meant, as indicated by the letter T. When brush width is referred to, the dimension indicated by the W in FIG. 1 is meant, and it will be understood that the width of a brush is measured perpendicular to the plane of its thickness. Brush height refers to the dimension of the brush shown by the letter H in FIG. 1, as measured from the brush bearing surface to the upper end of the brush on which brush-biasing springs are normally positioned during operation of the brush to bias it against a commutator, slip ring or other relatively movable conducting surface.

It should also be appreciated at the outset that the American National Standards Institute has established certain standard incremental size changes for brushes ranging in width from one up to two and one-half inches wide. That standard incremental change in width is one-quarter inch per step. For extra wide brushes, which are defined herein as being brushes three inches or more in width, such standard incremental changes are not required by ANSI.

As mentioned above, during the discussion of the background of the invention, it is desirable to restrict circulating brush currents in relatively thick brushes by forming the brushes of separate wafers or sections. Such a wafered brush 1 is shown in FIG. 1 as containing wafers 1A and 1B. The wafers 1A and 1B are secured at the pigtails only. Steel clips 2 and 3 are secured to the longer brush wafer 1A and overhang the short wafer 1B once the brush has been installed in the brush holder. These clips are used to transmit the force between the brush springs and the brush top. Other conventional means may be used for the same purpose and may or may not secure the spring-force-end of the wafers together. Likewise, suitable pigtail conductors 1A' and 1B' are imbedded, respectively, in wafers 1A and 1B to provide means for electrically connecting the extra-wide brush 1 to a conductive brush holder or other suitable conventional conductor as will be more fully explained below.

Since my invention is most advantageously applied to high-powered, high-speed direct current machines, it should be understood that as used in connection with the description of the invention herein the terms high-powered and high-speed are defined as follows: High-powered means any direct current machine applied at current rating greater than 1000 amperes with frequently applied loads requiring 1800 amperes or more; or as, any direct current machine requiring more than four standard size brushes per brush stud. High-speed means any direct current machine whose commutator operates at a peripheral speed in excess of 5000 feet per minute.

Figure 2:
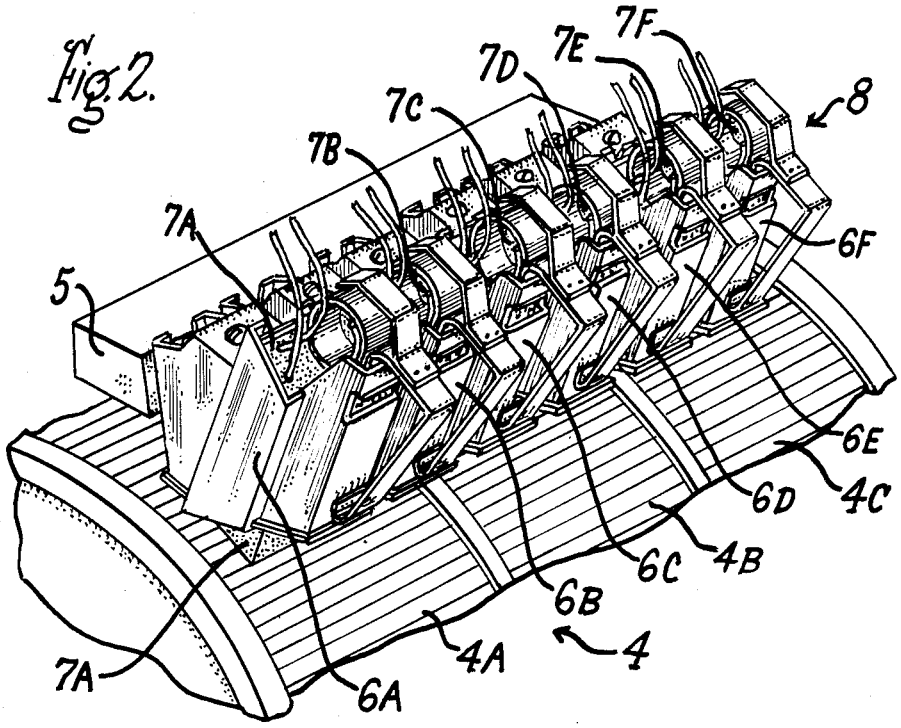
FIG. 2 is a perspective view of a high-powered dynamoelectric machine commutator having three raised face sections and having brush studs (only one shown) that each effectively mount six standard brush holders in operating position so that pairs of standard brushes housed in respective brush holders are positioned for sliding cooperation with each of the raised commutator face sections. All six brushes commonly mounted on each brush stud are electrically connected in parallel with one another.

Now that the meaning of certain critical terms used in this disclosure have been established, and the standard terminology for brush dimensions has been described, and one suitable form of extra-wide brush for practicing the invention has been explained with reference to FIG. 1, reference will be made to FIGS. 2 through 6 to explain my novel process for preventing film stripping and grooving of a dynamoelectric machine commutator on a high current machine that was originally designed to utilize a plurality of sets of brush holders for mounting six or more electrically paralleled brushes on common brush studs. Thus, in FIG. 2 there is shown a portion of a current state of the art high-powered, high-speed dynamoelectric machine commutator which is provided with three raised brush track faces, 4A, 4B and 4C. It will be understood that a plurality of brush studs such as the stud 5 shown in FIG. 2, are mounted in a suitable conventional manner around the commutator 4, and a plurality of sets of standard brush holders are secured, respectively, by suitable brush holder mounting means to the associated studs. As is common in such machines, an even number of brush holders, in this case 6 holders, 6A, B, C, D, E and F, are mounted in juxtaposed pairs on the associated stud 5 shown in FIG. 2. Each of the brush holders 6A-F is thus positioned in operating relationship to the commutator 4 for supporting a brush of a predetermined standard size in each holder and in sliding cooperation with one of the raised surfaces of commutator 4. A set of such standard-size brushes 7A-F is shown, each brush being mounted, respectively, in one of the brush holders 6A-F in FIG. 2. As the description of the invention proceeds, it will become apparent that the invention can be applied successfully on machines that are initially designed to use either an even, or an odd, number of brushes mounted on each of the brush studs.

The second brush track from the end of the commutator 4, as seen in the raised section 4A is, for the purpose of describing the invention, assumed to have been at least partly stripped of its protective lubricating film so partial grooving of that track on the commutator has occurred. The process of my invention is effective to prevent such film stripping and further grooving of the commutator even though the particular causes of such stripping, or knowledge of a specific set of combined circumstances leading to such grooving, may not be fully available or adequately understood with respect to any specific failure. Thus, it will be seen that the process can be practiced in the absence of such detailed data concerning causation of the failure.

In order to practice the process of my invention to prevent further film stripping and grooving of the commutator 4 of the high-powered type of dynamoelectric machine shown in FIG. 2, the steps of the process illustrated in FIG. 6 need only be carried out as follows: First, each of the originally provided standard-width brush holders, 6A-F and brushes 7A-F, respectively mounted therein, are removed from the brush holder mounting stud 5 that is associated with them. Likewise, all of the other standard-size brush holders and associated standard-size brushes are removed from their respective common brush holder mounting studs that are positioned around the remainder of the circumference of the commutator 4. Next, each juxtaposed pair of the originally provided brush holders, such as the pairs 6A-6B, 6C-6D and 6E-6F, as well as the similar pairs on the other brush holder studs of the machine, is replaced, respectively, with a unique extra-wide brush holder such as the brush holder 8 shown in FIGS. 4 and 5. Each extra-wide brush holder is effective, when mounted on one of the associated brush holder studs, to support an extra-wide brush, such as the extra-wide brush 1 shown in FIG. 1, in sliding cooperation with the commutator 4. When all of the extra-wide brush holders are suitably mounted in operating position on the respective studs around the commutator 4, an extra-wide brush, such as the brush 1, which in accordance with the invention is made to have a width substantially greater than the width of one of the standard size brushes 7A, B, etc., is disposed in operating position in the respective brush holders. Each of the extra-wide brush holders and its associated extra-wide brush is electrically connected in parallel with the other extra-wide brushes mounted in common with it on an associated brush holder stud, such as the stud 5 shown in FIG. 2. The brushes are all thus connected through the respective studs in a suitable conventional operating relationship to the armature winding of the dynamoelectric machine, essentially in the same manner as the originally provided standard brushes were so connected.

It has been found that this unique process is effective to restrict the range of current density unbalance in the three extra-wide brushes so mounted, respectively, on the stud 5 (and those mounted on the other brush studs), in sliding cooperation with the raised faces of commutator sections 4A, B and C, so that the current density range does not vary from the average brush current density more than 10 to 15% of the rated current density at rated load. Thus, further film stripping and commutator grooving is prevented by implementing the process of my invention. Of course, if significant grooving of the commutator has occurred in the brush track from which a film was stripped, it may be necessary to resurface that raised section, such as the illustrated stripped track section 4A shown in FIG. 2, before restarting the dynamoelectric machine after replacing the originally provided standard size brush holders and associated brushes with the extra-wide brush holders and brushes according to the process of my invention.

I have found in practicing my invention that it is particularly useful in preventing film stripping and commutator grooving on high-powered, high-speed dynamoelectric machines, that were originally provided with at least six or eight parallel connected brush holders mounted in common on each of a plurality of brush studs arranged around a commutator. Also, it is critical to the effective implementation of my process that the width of each of the extra-wide brushes used be at least about twice the width of one of the standard size brushes that it replaces. And, in the most preferred arrangement of the process of my invention, each extra-wide brush is made to be more than twice and less than three times the width of one of the standard size brushes originally provided with the dynamoelectric machine that is to be repaired by the process. By way of further example, in one successfully tested case, four juxtaposed pairs of standard size brushes mounted in common on an associated brush holder stud were each of a standard one and one-half inch width, and each such pair of brushes (on that stud and the other studs of the machine) was replaced, respectively, by a single extra-wide brush having a width of 3.125 inches thereby effecting a successful practical demonstration of this one preferred arrangement of the process of my invention.

If an operating machine that is to be repaired with the process of my invention happens to have an odd number of standard width brushes, such as five or seven brushes per brush stud, it will be recognized that in replacing those brushes with extra-wide brushes, either an odd or even number of such extra-wide brushes may be mounted on each brush stud. It is important that the load current capacity of the new brushes at least equal the original overall brush current capacity even though roughly half the number of original brushes will be used. Thus, for a machine having five standard size brushes per brush stud, three extra-wide brushes would be substituted, appropriately mounted on each stud. Similarly, if a machine having seven standard size brushes per brush stud is repaired by the process of the invention, four extra-wide brushes would be mounted on each stud.

In order to facilitate the practice of the preferred arrangement of the process of my invention, it is desirable to use the same brush holder studs, i.e. 5, etc. and their respective associated brush holder mounting means, to mount the extra-wide brush holders 8 in operating position, as were used to mount the original standard size brush holders 6A-F in their respective operating positions. In addition, I have found that it is often more economical to modify the original standard size brush holders to enable them to serve as extra-wide brush holders, rather than to manufacture, or provide at possibly remote locations where a failure may have occurred, completely new extra-wide brush holders that suitably enable the extra-wide brushes 1, etc. to be mounted in operating position on a commutator, as explained above.

Figure 4:
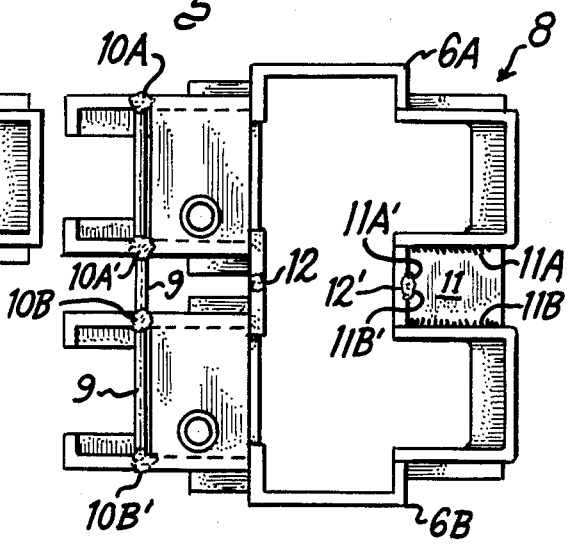
FIG. 4 is a top plan view of an extra-wide brush holder that is constructed according to the method of the present invention and is useful in the disclosed preferred process of the invention as well as being useful for constructing a preferred embodiment of the apparatus of the invention.
Figure 5:
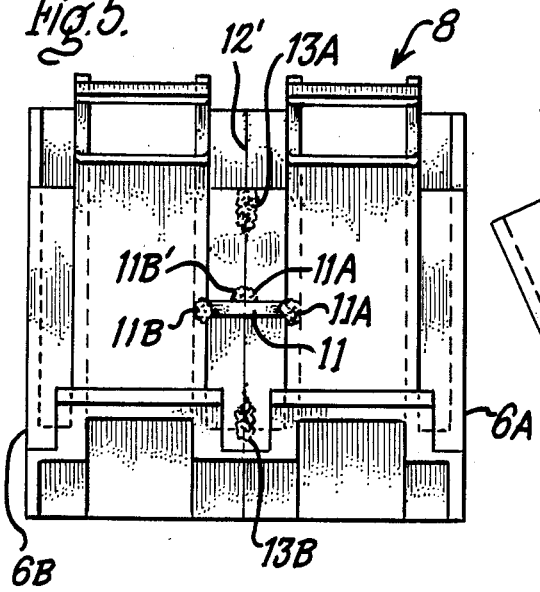
FIG. 5 is a side elevation view of the extra-wide brush holder shown in FIG. 4.
Figure 6:
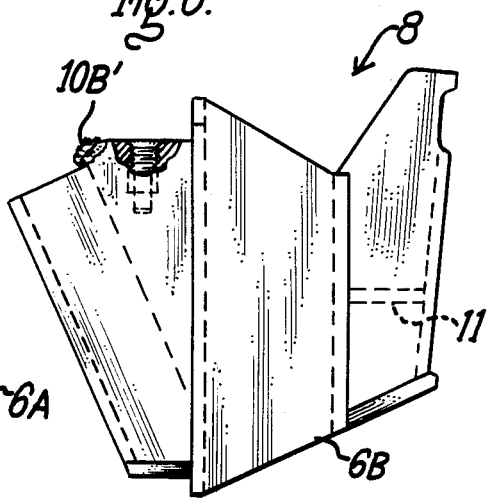
FIG. 6 is a side view of the brush holder shown in FIGS. 4 and 5.
Figure 7:
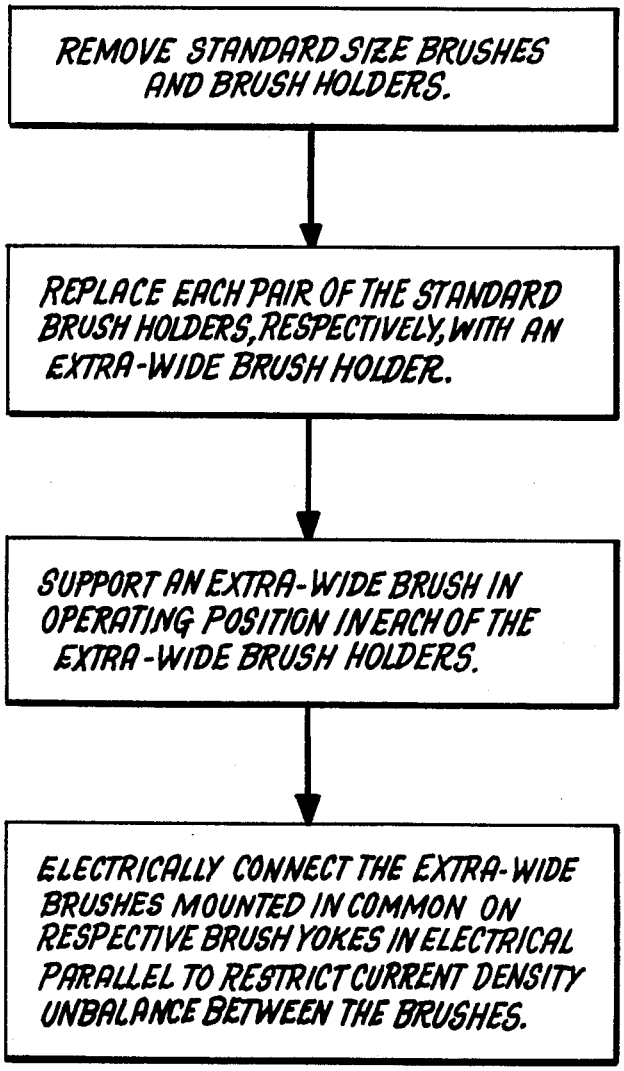
FIG. 7 is a flow chart illustrating a preferred arrangement of the process steps of the invention.

FIGS. 4 and 5 of the drawing illustrate a preferred form of an extra-wide brush holder that has been formed, according to the invention, by suitably modifying a pair of the originally provided standard size brush holders, such as brush holders 6A and 6B shown in FIG. 2, to make an extra-wide brush holder thereof. According to further steps of the preferred arrangement of the process of the invention, the extra-wide brush holder 8 shown in FIGS. 4 and 5 is made by modifying a pair of the originally provided brush holders such as the holders 6A and 6A, by removing the sides of each of those standard size brush holders that face the juxtaposed brush holder of its pair.

Figure 3:
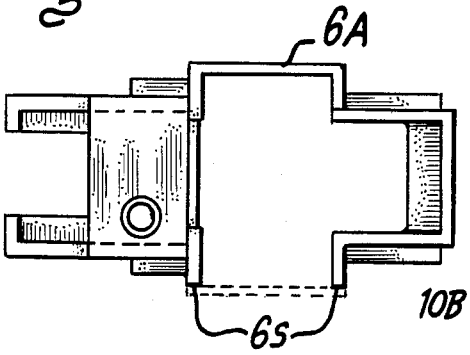
FIG. 3 is a top plan view of one of the standard size brush holders shown in FIG. 2, illustrating with a phantom section of one side of the holder a modification that is made in practicing a preferred arrangement of the process of the present invention.

To more clearly illustrate that step of the process, there is shown in FIG. 3 a top plan view of the standard size brush holder 6A. Phantom lines at the bottom of that figure illustrate the side 6S that has been removed by a suitable machining step, such as by sawing or by using some conventional grinding process, to remove it from the body of the brush holder 6A. It will be understood that a similar machining process will be performed to remove a similar portion of the juxtaposed side of brush holder 6B, and like modifications will be made to the remainder of the juxtaposed pairs of standard size brush holders mounted around the commutator 4. Following the removal of the juxtaposed sides of the respective pairs of standard size brush holders, each such pair of brush holders is then secured together, by moving their juxtaposed edges into abutting relation and fusing predetermined abutting surfaces thereof together. To clearly illustrate that step of the process of the invention, there is shown in FIG. 4 a first rod or bar 9, that may be made of brass or other suitable metal, which is fused to at least two points 10A, 10A' and 10B, 10B', respectively, on suitable first outer surfaces of each of the modified brush holders, 6A and 6B of the juxtaposed pair used to form the extra-wide brush holder 8. In order to further secure the modified brush holders 6A and 6B together, a second metal bar 11 which may be in the form of a generally flat, brass plate or other suitable metal bracket structure, is fused at selected areas to at least two points 11A, 11A' and 11B, 11B', respectively, on a second outer surface thereof opposite to the first outer surface to which the first bar 9 is fused.

It will be understood that similar first and second bars and associated welding or other fusing operations will be used to secure other modified, juxtaposed pairs of standard size brush holders together in order to form the required number of extra-wide brush holders to replace all of the standard size brush holders around the commutator 4, in practicing the preferred process of the invention. Finally, in order to still further secure the modified pairs of standard size brush holders rigidly together, portions of the seams 12 and 12' may be welded or otherwise suitably fused together at spaced points, if certain applications require such further rigidifying steps. Of course, if the seams 12 and 12' are so welded, it is necessary to assure that the brush-contacting surfaces of the seams be machined smooth to prevent any irregularities on those surfaces from restricting free sliding movement of an extra-wide brush in the brush holder, as normal wear of the brush requires it to be moved downward against a commutator 4 during typical operation of the machine. Two such welded spots, 13A and 13B, are shown, by way of example, on the seam 12' illustrated in FIG. 5. Similar welds can be applied to portions of the seam 12, if required in a given application. It will be understood that additional welds or other suitable bracket or gusset means may be used to further secure and rigidity the modified standard size brush holders 6A and 6b to make them into the desired extra-wide brush holder 8, used in practicing the process of the invention.

After all of the originally provided standard size brush holders have been so modified and secured together in juxtaposed matched pairs to form the necessary extra-wide brush holders for use in the succeeding step of the process of the invention, each of the resulting extra-wide brush holders is mounted to one of the respective studs 5, etc. with the same mounting means that were used to mount the originally provided brush holders to those studs. It will be understood that any suitable conventional brush holder mounting means, such as mounting clips or screws (not shown) like those provided to mount the original standard size brush holders to the studs, may be used in practicing that step of the process of the invention. It will be recognized that in an alternative application of the invention, where an odd number of brushes were originally mounted on each brush stud, it may be necessary to drill new holes, or use supplementary brush holder mounting means to mount some of the extra-wide brushes on the studs.

Now that a preferred arrangement of the process of the invention has been explained with reference to the manner in which it is usable to prevent commutator film stripping and commutator grooving on a machine that was originally provided with standard size brushes and associated brush holders, it should be understood that the teaching of the invention can be further applied as a method of making a high-powered, high-speed dynamoelectric machine in its original form. In such a use of the invention, a machine is provided with a plurality of extra-wide brush holders and associated extra-wide brushes which are each mounted in cooperative sliding relationship with a commutator on the machine, as it is initially assembled, in order to prevent film stripping and grooving of the commutator. In one preferred arrangement of the method of the invention thus used to manufacture a new machine, a suitable dynamoelectric machine is provided having a conventional armature, a suitable conventional commutator electrically connected to the armature, and a plurality of suitable brush holder studs for mounting sets of brush holders in operating position at spaced points around the commutator in a conventional manner.

The next critical step in practicing the method of the invention is to determine the minimum number of standard size brushes that would be required to carry the rated high armature current of the machine thus provided, then provide a plurality of extra-wide brushes equal in number to at least one-half the number of such standard size brushes as so determined. In the event an odd number of standard size brushes have been selected for the machine design, then the number of extra-wide brushes should be made equal in number to the next larger integer of one-half the number of such standard size brushes as so determined. Each of the extra-wide brushes thus provided must be made to have a width about twice that of the width of one of the standard size brushes identified in the second step of the method. A plurality of suitable extra-wide brush holders are then provided and each such extra-wide brush holder is made to support one of the extra-wide brushes in operating position relative to the machine commutator. It will be appreciated that such a suitable extra-wide brush holder can be formed in the manner explained above with reference to FIGS. 4 and 5, or a unitary extra-wide brush holder can be cast from bronze or other suitable material and then machined to provide smooth brush engaging sliding surfaces for the extra-wide brushes provided in the earlier step of the method. Finally, the plurality of extra-wide brush holders thus provided is mounted in sets on respective brush holder studs to position each of the extra-wide brushes, disposed respectively in the brush holders, in operating relationship to slide cooperatively on the surface of the commutator. It will be understood that a machine made by practicing the foregoing method steps of the invention will operate in the same desirable manner as explained above relative to the process of the invention for preventing film stripping and grooving of a commutator on such a high-powered, high-speed dynamoelectric machine originally provided with standard size brushes and brush holders.

In one arrangement of the method of the invention, as noted above, each of the extra-wide brush holders used in practicing the method of the invention can be made by, first, modifying a pair of standard size brush holders that were originally adapted to mount one of the standard size brushes, the size of which was determined in the second step of the method of the invention, in suitable operating position adjacent to a commutator then, second, securing the standard size brush holders together in matched pairs in order to provide the desired plurality of extra-wide brush holders, according to the process steps explained above with reference to FIGS. 4 and 5.

I have also found in practicing the method of the invention that it is desirable to limit the number of parallel connected extra-wide brushes mounted in common on one of the brush holder studs to a maximum of three or four such brush holders and associated brushes per stud. Thus, in a further preferred refinement of the method steps of the invention, it is recommended that the number of standard size brushes determined by the second step of the above-described arrangement of the method of the invention be divided into at least three pairs of brushes for each of the commonly mounted sets of the brushes on a given brush holder stud. One should make each of the extra-wide brushes used in practicing the method of the invention more than twice and less than three times as wide as the width of one of the standard size brushes, and mount each such extra-wide brush, respectively, in one of the extra-wide brush holders, as explained above. Thus, three extra-wide brushes would be mounted on each brush holder stud in constructing a dynamoelectric machine according to the most preferred arrangement of the method of the invention.

It should be apparent to those skilled in the art from the description of the invention that has been given thus far, that relatively conventional high-powered, high-speed dynamoelectric machines can be improved by being made to incorporate the kinds of extra-wide brushes and associated extra-wide brush holders that are needed to practice the process and method of the invention. In order to clearly describe the novel features of such an improvement in those kinds of dynamoelectric machines, a brief description of one preferred embodiment of such an improved machine will now be given. Because the structure of such an improved machine will be essentially the same as that resulting from the practice of either the earlier described process or method, reference may be made, as necessary, to FIGS. 1–5 of the drawing to help visualize suitable component pairs of the structure being described.

Accordingly, considering such an improvement in dynamoelectric machines, start with the premise that there is first fabricated a relatively conventional dynamoelectric machine having selected high power and high speed ratings. The machine is provided with a suitable conventional armature, a commutator electrically connected to the armature, and a plurality of brush holder studs that are adapted to cooperate, respectively, with brush holder mounting means of any suitable conventional configuration for effectively mounting standard size brush holders in sets of predetermined number on the given studs. The brush holder mounting means for mounting each brush holder to one of the respective studs are operable to position the brushes in the holders for sliding cooperation, respectively, with predetermined tracks on the running surface of the commutator, all in any suitable conventional manner as is generally well known to those skilled in the art. Such a dynamoelectric machine is improved, according to the invention by mounting a plurality of extra-wide brush holders so that each such holder is mounted, respectively, in operating position on one of the brush holder studs by at least one of the mounting means that are suitable for mounting standard size brush holders on the studs. A plurality of extra-wide brushes, each made to be about twice the width of a brush having a size that would normally be usable with one of the standard size brush holders for which the brush holder mounting means are adapted, are mounted, respectively, in operating relationship in the extra-wide brush holders. Such an improved structural arrangement of the dynamoelectric machine is operable to prevent current density unbalance between the respective extra-wide brushes mounted in common on any one of the brush holder studs to a range of 10 to 15% of average brush current, thereby to prevent the occurrence of film stripping and grooving of the commutator.

As mentioned earlier, above, it is now common for current state of the art high-powered, high-speed dynamoelectric machines, of the type having a plurality of brushes electrically connected in parallel and mounted on common brush holder studs, to experience current density unbalances between the respective brushes in the range of about 50 to 80%. Such an undesirably wide range of unbalance can cause brush dusting, as well as film stripping and grooving of the commutator; consequently, the improved structure of my invention, which restricts the range of current density unbalance in the respective brushes to 20 to 30% and thus avoids such undesirable, catastrophic wear rates of the brushes, and resultant film stripping and grooving of the commutator, are most beneficial and are economically feasible of attainment by utilization of the invention.

In the most preferred improved dynamoelectric machine structure of my invention described herein, each of the extra-wide brush holders is mounted in operating position by securing it to an associated brush holder stud with two holding clips or other relatively conventional brush holder mounting means that are adapted to also mount a standard size brush holder in operating position on the stud; should such standard size brush holders be used in the machine in alternative applications of it, rather than using extra-wide brush holders according to the teaching of my invention. Also in this preferred form of the invention each of the extra-wide brush holders is made to include a pair of suitable, conventional self-winding, brush-biasing springs (not shown, except as in FIG. 2) that are each mounted in conventional manner (such as that depicted in FIG. 2) on the brush holders to bias an extra-wide brush positioned in the respective holders against the commutator during normal operation of an improved dynamoelectric machine constructed according to my invention. Finally, in constructing machines according to the teaching of my invention I have discovered that it is desirable to restrict the number of extra-wide brush holders used on any given common brush holder stud to a maximum of four such extra-wide brush holders. Thus, in contructing an improved dynamoelectric machine according to the invention, either three or four extra-wide brush holders and associated brushes can be mounted in operating position on each of the brush holder studs positioned around the commutator. Of course, the same number of extra-wide brushes should be used on each of the respective brush holder studs in any given machine.

From the foregoing description of the invention, its operation in the various arrangements and forms described will be readily understood. It will also be appreciated that various alternative embodiments and further modifications of the invention may be made from the teaching of it presented herein; accordingly, it is my intention to encompass within the limits of the following claims the true scope and spirit of the invention.

I claim:

1. A process for preventing film stripping and grooving of a commutator on a high-powered, high-speed dynamoelectric machine that has a plurality of sets of brush holders, each said set comprising an even number of brush holders mounted in juxtaposed pairs on an associated brush holder stud for supporting a brush of predetermined standard size in each brush holder and in sliding cooperation with the commutator, said process comprising the steps of:

(a) removing each of said brush holders and the brushes therein from the mounting studs associated respectively therewith, (a-1) modifying each said pair of the standard size brush holders and securing them together to make an extra-wide brush holder thereof, (b) replacing each juxtaposed pair of said brush holders, respectively, with an extra-wide brush holder that is effective when mounted on its stud to support an extra-wide brush in sliding cooperation with the commutator, (b-1) mounting said modified and secured together, extra-wide brush holders to the respective studs with the mounting means used to originally mount standard size brush holders to the studs, (c) disposing an extra-wide brush, having a width substantially greater than the width of one of said standard size brushes, in operating position in each of said extra-wide brush holders, and (d) electrically connecting in parallel each of said extra-wide brushes in a set of brushes mounted in common on the respective studs thereby to limit current density unbalance between the brushes in each set to a range of 10 to 15% of average brush current.

2. A process as defined in claim 1 wherein said even number of originally provided brush holders comprises at least six, and wherein the width of each of said extra-wide brushes is about twice the width of one of said standard size brushes.

3. A process as defined in claim 2 wherein the width of each extra-wide brush is more than twice and less than three times the width of one of said standard size brushes.

4. A process as defined in claim 1 including the steps of:

(a-2) modifying each pair of said standard size brush holders by removing a side thereof facing the juxtaposed brush holder of its pair, and (a-3) securing each pair of standard size brush holders together by moving the juxtaposed edges thereof into abutting relation and fusing predetermined abutting surfaces thereof together.

5. A process as defined in claim 1 including the steps of:

(a-4) fusing parts of a first bar to at least two points on a first outer surface of each modified brush holder in a juxtaposed pair, thereby to further secure them together, and (a-5) fusing parts of a second bar to at least two points on an outer second surface opposite to said first outer surface of each modified brush holder in each juxtaposed pair, thereby to further secure them together.

6. A method of making a high-powered, high-speed dynamoelectric machine with a plurality of extra-wide brush holders and associated extra-wide brushes, each of said brushes being mounted in cooperative sliding relationship with a commutator on the machine to prevent film stripping and grooving of the commutator, comprising the steps of:

(a) providing a dynamoelectric machine having an armature, a commutator electrically connected therewith, and a plurality of studs for mounting sets of brush holders in operating position adjacent to the armature, (b) determining the minimum even number of standard size brushes required to carry the rated high armature current of the machine, (c) providing a plurality of extra-wide brushes equal in number to half the number of standard size brushes determined by step (b) and making each of said extra-wide brushes about twice as wide as the width of one of said standard size brushes, (d) providing a plurality of extra-wide brush holders, each adapted to support one of said extra-wide brushes in operating position, (d-1) making each of said extra-wide brush holders by; (1) modifying a pair of standard size brush holders that were originally adapted to mount one of said standard size brushes in operating position, thereby to enable each pair of said standard size brush holders to support an extra-wide brush in operating relationship to the commutator, and (2) securing the standard size brush holders together in said pairs, thereby to provide said plurality of extra-wide brush holders, and (e) mounting a plurality of extra-wide brush holders in sets on respective brush holder studs to position each of said extra-wide brushes in operating relationship on the commutator, thereby to restrict current density unbalance between the extra-wide brushes in each set to a range of 10 to 15% of the average brush current.

7. A method as defined in claim 6 including the step of:

(b-1) dividing the number of standard size brushes determined by step (b) into at least three and no more than four, pairs of brushes for each of said sets, and (c-1) making each of said extra-wide brushes more than twice and less than three times as wide as the width of one of said standard size brushes.

* * * * *